US007662766B2

(12) United States Patent
Ford et al.

(10) Patent No.: US 7,662,766 B2
(45) Date of Patent: Feb. 16, 2010

(54) FABRIC SOFTENING COMPOSITION

(75) Inventors: Gary James Peter Ford, Wirral (GB); Stephane Patrick Roth, Kingston-upon-Thames (GB); Laurent Soubiran, Teddington (GB)

(73) Assignee: The Sun Products Corporation, Wilton, CT (US)

( * ) Notice: Subject to any disclaimer, the term of this patent is extended or adjusted under 35 U.S.C. 154(b) by 3 days.

(21) Appl. No.: 11/631,997

(22) PCT Filed: Jul. 1, 2005

(86) PCT No.: PCT/EP2005/007230

§ 371 (c)(1),
(2), (4) Date: Jan. 9, 2007

(87) PCT Pub. No.: WO2006/005480

PCT Pub. Date: Jan. 19, 2006

(65) Prior Publication Data

US 2008/0305984 A1 Dec. 11, 2008

(30) Foreign Application Priority Data

Jul. 15, 2004 (GB) ..... 0415832.5

(51) Int. Cl.
*C11D 1/835* (2006.01)

(52) U.S. Cl. ..... 510/522; 510/527

(58) Field of Classification Search ..... 510/522, 510/527

See application file for complete search history.

(56) References Cited

U.S. PATENT DOCUMENTS

| | | | | |
|---|---|---|---|---|
| 5,652,206 | A * | 7/1997 | Bacon et al. | 510/101 |
| 5,668,102 | A * | 9/1997 | Severns et al. | 510/504 |
| 7,015,188 | B2 * | 3/2006 | Adama et al. | 510/527 |
| 2001/0006937 | A1 | 7/2001 | Charlton et al. | 510/515 |
| 2003/0092591 | A1 | 5/2003 | Ellson et al. | 510/329 |
| 2004/0033931 | A1 * | 2/2004 | Adama et al. | 510/515 |

FOREIGN PATENT DOCUMENTS

| | | |
|---|---|---|
| EP | 1 054 032 | 11/2000 |
| EP | 0 829 531 | 3/2004 |
| WO | 97/22594 | 6/1997 |
| WO | 00/71806 | 11/2000 |
| WO | 01/96510 | 12/2001 |
| WO | 02/33032 | 4/2002 |
| WO | 03/012019 | 2/2003 |

OTHER PUBLICATIONS

PCT Search Report in a PCT application PCT/EP2005/007230.
GB Search Report in a GB application GB 0415832.5.

* cited by examiner

*Primary Examiner*—John R Hardee
(74) *Attorney, Agent, or Firm*—Stern, Kessler, Goldstein & Fox P.L.L.C.

(57) ABSTRACT

A liquid fabric softening composition comprising an aqueous base, a cationic fabric softening agent, and an emulsified oil which has a refractive index at 25° C. of 1.45 or greater in an amount such that the weight ratio of oil to cationic fabric softening agent is from 1:12 to 1:1, characterised in that the D[4,3] droplet size of the emulsified oil is from 0.4 to 8 microns.

13 Claims, No Drawings

FABRIC SOFTENING COMPOSITION

TECHNICAL FIELD

The present invention relates to fabric softening compositions. In particular the invention relates to fabric softening compositions that are visually and rheologically appealing to consumers.

BACKGROUND AND PRIOR ART

It is well known to, provide liquid fabric softening compositions that soften treated fabric. Such compositions are typically added to fabric in the rinse cycle of the wash process. We have observed that consumer preference is for liquid fabric conditioners that appear thick and creamy, cued by having a high viscosity at low shear and a high opacity. Conditioners that appear thin and/or translucent/watery may be perceived as being cheap and ineffective, whereas conditioners that appear thick and creamy are perceived as premium products. To date, there is limited technology that allows the alteration of viscosity and opacity without causing problems such as poor dispensing or poor storage stability.

We have found that liquid fabric conditioners that appear thick and creamy may be prepared by adding particular levels of an emulsified oil of particular particle size to a dispersion of conventional cationic fabric softening agent in water.

Fabric conditioners comprising oils and cationic softening agent are known in the art. For example, WO 97/22594 discloses fabric softeners comprising cationic softening agent and a perfume carrier substance that may be tallow oil or palm oil.

WO 00/71806 discloses fabric softeners comprising a cationic softening compound and an emulsified silicone, in one aspect the median silicone droplet size in the emulsion being at least 0.25 micron and preferably no greater than 25 micron.

WO01/96510 discloses an aqueous fabric softening composition comprising:

(i) a cationic fabric softening agent comprising at least two long hydrocarbyl chains;

(ii) one or more oils comprising from 8 to 40 carbon atoms; and (iii) one or more nonionic stabilisers comprising a nonionic alkoxylate having an average alkoxylation number of from 10 to 40 wherein the composition is in the form of a macro-emulsion. Typically, the oil droplets in the macro-emulsion have a diameter between 0.1 to 40 μm. There is no disclosure of preferred average droplet sizes.

WO02/33032 discloses an aqueous, liquid fabric conditioning composition comprising:

(i) from 2.1 to 7% of a quaternary ammonium cationic softening compound; and (ii) a perfume having a ClogP or 2 or more; and (iii) an oily perfume carrier having a ClogP of 3.5 or more;

where the composition comprises an emulsion in which 80% or more weight of the droplets in the emulsion have a mean diameter of from 0.4 to 60 microns, as measured using a Malvern particle size analyser with a 45 mm lens for D[0,1] measurements and both a 45 mm and a 1000 mm lens for D[0,9] measurements. The Examples disclose formulations with a wide range of droplet sizes. There is no disclosure of preferred average droplet sizes.

WO03/012019 discloses an aqueous, liquid fabric conditioning composition comprising:

(i) a quaternary ammonium cationic softening compound; and (ii) a nonionic surfactant where the composition comprises an emulsion in which 80% or more by weight of the droplets in the emulsion have a mean diameter of from 0.4 to 60 microns, as measured using a Malvern particle size analyser with a 45 mm lens for D[0,1] measurements and both a 45 mm and a 100 mm lens for D[0,9] measurements. The compositions may comprise perfume and an oily perfume carrier. There is no disclosure of the preferred average droplet sizes.

WO00/71806 and EP 1054032 disclose fabric softening compositions comprising siloxane or silicone emulsions.

SUMMARY OF INVENTION

According to a first aspect of the invention, there is provided a liquid fabric softening composition comprising an aqueous base, a cationic fabric softening agent, and an emulsified oil which has a refractive index at 25° C. of 1.45 or greater in an amount such that the weight ratio of oil to cationic fabric softening agent is from 1:12 to 1:1, characterised in that the D[4,3] droplet size of the emulsified oil is from 0.4 to 8 microns.

According to a second aspect of the present invention, there is provided a method for the treatment of fabrics comprising contacting fabrics with a liquid fabric softening composition according to the first aspect of the invention or any of the particular variants thereof disclosed in the following description.

According to a third aspect of the present invention, there is provided a method for the manufacture of a liquid fabric softening composition comprising the dispersion of a cationic softening agent and an oil which has a refractive index at 25° C. of 1.45 or greater in an aqueous base, the components being mixed at a weight ratio of cationic softening agent to oil of from 1:1 to 12:1 and processed to give a final D[4,3] droplet size for the oil of from 0.4 to 8 microns.

In the context of the present invention, the term Acomprising≅ means Aincluding≅ and is non-exhaustive.

DETAILED DESCRIPTION OF THE INVENTION

The compositions of the invention have surprisingly high turbidity and appear thick and creamy to the consumer. Despite this fact, they leave little residue in the dispenser draw of automatic washing machines and are stable for prolonged periods of time, even at non-ambient temperatures.

The compositions of the invention are both visually and rheologically appealing to consumers. They have relatively high turbidity (vide infra) giving them a thick and creamy visual appearance and they also have relatively high viscosity at relevant shear rates. At the low shear rates relevant to the pouring of the composition and its dispensing, it is particularly important that the composition is thick and creamy. At a shear rate of 2/s, the composition may have a viscosity from 100 to 1000 mPa·s, in particular from 150 to 750 mPa·s, and especially from 250 to 450 mPa·s, and yet still dispense efficiently. Viscosities are measured at ambient temperature, i.e. about 20° C., on instruments such as a Haake rotoviscometer.

The Cationic Softening Agent

The cationic softening is generally one that is able to form a lamellar phase dispersion in water, in particular a dispersion of liposomes.

The cationic softening agent is typically a quaternary ammonium compound ("QAC"), in particular one having two $C_{12-28}$ groups connected to the nitrogen head group that may independently be alkyl or alkenyl groups, preferably being connected to the nitrogen head group by at least one ester link, and more preferably by two ester links.

The average chain length of the alkyl and/or alkenyl groups is preferably at least $C_{14}$ and more preferably at least $C_{16}$. It is particularly preferred that at least half of the groups have a chain length of $C_{18}$. In general, the alkyl and/or alkenyl groups are predominantly linear.

A first group of QACs suitable for use in the present invention is represented by formula (I):

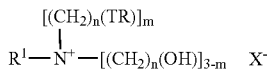

(I)

wherein each R is independently selected from a $C_{5-35}$ alkyl or alkenyl group; $R^1$ represents a $C_{1-4}$ alkyl, $C_{2-4}$ alkenyl or a $C_{1-4}$ hydroxyalkyl group; T is generally O—CO. (i.e. an ester group bound to R via its carbon atom), but may alternatively be CO.O (i.e. an ester group bound to R via its oxygen atom); n is a number selected from 1 to 4; m is a number selected from 1, 2, or 3; and $X^-$ is an anionic counter-ion, such as a halide or alkyl sulphate, e.g. chloride or methylsulphate. Di-esters variants of formula I (i.e. m 2) are preferred and typically have mono- and tri-ester analogues associated with them. Such materials are particularly suitable for use in the present invention.

Especially preferred agents are di-esters of triethanolammonium methylsulphate, otherwise referred to as "TEA ester quats". Commercial examples include Prapagen TQL, ex Clariant, and Tetranyl AHT-1, ex Kao, (both di-[hardened tallow ester] of triethanolammonium methylsulphate), AT-1 (di-[tallow ester] of triethanolammonium methylsulphate), and L5/90 (di-[palm ester] of triethanolammonium methylsulphate), both ex Kao, and Rewoquat WE15 (a di-ester of triethanolammonium methylsulphate having fatty acyl residues deriving from $C_{10}$-$C_{20}$ and $C_{16}$-$C_{18}$ unsaturated fatty acids), ex Witco Corporation.

The second group of QACs suitable for use in the invention is represented by formula (II):

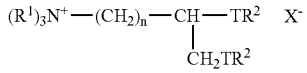

(II)

wherein each $R^1$ group is independently selected from $C_{1-4}$ alkyl, hydroxyalkyl or $C_{2-4}$ alkenyl groups; and wherein each $R^2$ group is independently selected from $C_{8-28}$ alkyl or alkenyl groups; and wherein n, T, and $X^-$ are as defined above.

Preferred materials of this second group include 1,2 bis[tallowoyloxy]-3-trimethylammonium propane chloride, 1,2 bis[hardened tallowoyloxy]-3-trimethylammonium propane chloride, 1,2-bis[oleoyloxy]-3-trimethylammonium propane chloride, and 1,2 bis[stearoyloxy]-3-trimethylammonium propane chloride. Such materials are described in U.S. Pat. No. 4,137,180 (Lever Brothers). Preferably, these materials also comprise an amount of the corresponding mono-ester.

A third group of QACs suitable for use in the invention is represented by formula (III):

$$(R^1)_2—N^+—[(CH_2)_n\text{-}T\text{-}R^2]_2X^- \quad \text{(III)}$$

wherein each $R^1$ group is independently selected from $C_{1-4}$ alkyl, or $C_{2-4}$ alkenyl groups; and wherein each $R^2$ group is independently selected from $C_{8-28}$ alkyl or alkenyl groups; and n, T, and $X^-$ are as defined above. Preferred materials of this third group include bis(2-tallowoyloxyethyl)dimethyl ammonium chloride and hardened versions thereof.

A fourth group of QACs suitable for use in the invention is represented by formula (IV):

$$(R^1)_2—N^+—(R^2)_2X^- \quad \text{(IV)}$$

wherein each $R^1$ group is independently selected from $C_{1-4}$ alkyl, or $C_{2-4}$ alkenyl groups; and wherein each $R^2$ group is independently selected from $C_{8-28}$ alkyl or alkenyl groups; and $X^-$ is as defined above. Preferred materials of this fourth group include di(hardened tallow)dimethylammonium chloride.

The iodine value of the softening agent is preferably from 0 to 20, more preferably from 0 to 4, and most preferably from 0 to 2. Essentially saturated material, i.e. having an iodine value of from 0 to 1, is used in especially high performing compositions. At low iodine values, the softening performance is excellent and the composition has improved resistance to oxidation and associated odour problems upon storage.

Iodine value is defined as the number of grams of iodine absorbed per 100 g of test material. NMR spectroscopy is a suitable technique for determining the iodine value of the softening agents of the present invention, using the method described in *Anal. Chem.*, 34, 1136 (1962) by Johnson and Shoolery and in EP 593,542 (Unilever, 1993).

The softening agent is usually present in the compositions of the invention at a level of 5% or greater by weight of the total composition. For even greater softening effect, this level may be 8% or greater; whilst for particularly high performance, this level may be 11% or greater. At these higher concentrations, which are also desirable for supply chain and environmental reasons, the low dispenser residues found with the compositions of the present invention is particularly relevant and unexpected.

References to levels of cationic softening agent in this specification are to the total level of cationic softening agent, including all cationic components of a complex raw material that could enter aqueous lamellar phase together. With a di-ester softening agent, it includes any associated mono-ester or tri-ester that may be present.

For ease of formulation, the amount of softening agent is generally 50% or less, particularly 40% or less, and especially 30% or less by weight of the total composition.

The Emulsified Oil

The presence of an emulsified oil is key to the present invention. Generally, the emulsified oil exists as a separate disperse phase, within the aqueous base (continuous phase), which generally also carries dispersed fragments of lamellar phase of the cationic softening agent. The emulsified oil may function by increasing the turbidity of the fabric softening liquid more than would the same volume fraction of liposome droplets of the cationic softening agent. For a particularly effective turbidity increase, the oil used has a refractive index at 25° C. of 1.45 or greater, in particular from 1.45 to 1.50, and especially from 1.46 to 1.48. Such refractive indices are higher than those of polydimethylsiloxane (PDMS) and similar silicone/siloxane materials.

Compositions according to the invention having particularly good appearance (high turbidity) comprise an emulsified non-silicone oil; preferably such compositions comprise less than 5% by weight of silicone oil, more preferably less than 1% by weight of silicone oil, and most preferably they comprise no silicone oil.

The D[4,3] droplet size of the emulsified oil is from 0.4 to 8 microns, in particular from 0.4 to 4 microns, and especially from 1 to 2 microns. Such droplet sizes may be measured using standard light scattering methods, on instruments like the Malvern Mastersizer. The preferred droplet sizes help enable optimum turbidity for compositions according to the invention.

Preferred oils include mineral oils and ester oils, the latter including sugar polyesters and natural oils. Ester oils are particularly preferred, especially those derived from natural oils, such as vegetable oils and essential oils.

Suitable ester oils include fatty esters of mono- or polyhydric alcohols having from 1 to 24 carbon atoms in the hydrocarbon chain, and mono or polycarboxylic acids having from 1 to 24 carbon atoms in the hydrocarbon chain, provided that the total number of carbon atoms in the ester oil is equal to or greater than 16, and that at least one of the hydrocarbon chains has 12 or more carbon atoms.

Suitable ester oils include saturated ester oils, such as the PRIOLUBES (ex. Uniqema): 2-ethyl hexyl stearate (PRIOLUBE 1545), neopentyl-glycol monomerate (PRIOLUBE 2045) and methyl laurate (PRIOLUBE 1415) are particularly preferred, although oleic monoglyceride (PRIOLUBE 1407), neopentyl glycol dioleate (PRIOLUBE 1446), methyl oleate (Priolube 1400), n-butyl oleate (Priolube 1405), isobutyl oleate (Priolube 1414), propylene glycol dioleate (Priolube 1429) and isooctyl stearate (Priolube 1458) are also suitable.

Also suitable are ester oils available from Henkel, for example, decyl oleate (Cetiol V), glyceryl dioleate (Emerest 2419) and propyl oleate (Emerest 2302).

Suitable sugar polyesters include sucrose polyesters and similar materials, typical materials being those disclosed WO 01/46361.

Suitable mineral oils include the Marcol technical range and Aeroshell oils (both ex Esso) although particularly preferred is the Sirius range (ex Silkolene) or Semtol (ex. Witco Corp.).

Suitable vegetable oils include cotton seed oil, coconut oil, safflower oil, castor oil, corn oil, soybean oil, apricot kernel oil, palm kernel oil, sweet almond oil and sunflower oil.

One or more oils of any of the above mentioned types may be used.

It is preferred that the viscosity of the oil is from 0.002 to 0.4 Pa.s at a temperature of 25EC at 106 $s^{-1}$, measured using a Haake MV1 rotoviscometer. The density of the oil is generally from 0.8 to 1.0, and in particular from 0.8 to 0.9 $g.cm^{-3}$ at 25° C. The molecular weight of the oil is typically within the range 100 to 500.

The emulsified oil may be used for other functions described herein, as well as serving to increase the turbidity of the composition.

The weight ratio of emulsified oil to cationic fabric softening is from 1:12 to 1:1, in particular from 1:12 to 1:2, and especially from 1:10 to 1:2. Typically, the oil represents from 0.5 to 10%, in particular from 1 to 7%, and especially from 1 to 4.5% of the total weight of the composition.

The total amount of emulsified oil plus cationic softening agent is preferably 10% or greater, more preferably 11.5% or greater, and most preferably 13% or greater of the total weight of the composition. It is with such concentrated fabric softening compositions that the benefits of the invention have greatest relevance.

Emulsifier

To form the emulsion of the oil, an emulsifier is generally required. The emulsifier may be a nonionic or cationic surfactant and in preferred embodiments, both of these surfactants may be present.

Suitable nonionic surfactants include alkoxylated materials, particularly addition products of ethylene oxide and/or propylene oxide with fatty alcohols, fatty acids and fatty amines.

Preferred materials are of the general formula:

$$R—Y—(CH_2CH_2O)_zH$$

Where R is a hydrophobic moiety, typically being an alkyl or alkenyl group, said group being linear or branched, primary or secondary, and preferably having from 8 to 25, more preferably 10 to 20, and most preferably 10 to 18 carbon atoms; R may also be an aromatic group, such as a phenolic group, substituted by an alkyl or alkenyl group as described above; Y is a linking group, typically being O, CO.O, or CO.N($R^1$), where $R^1$ is H or a $C_{1-4}$ alkyl group; and z represents the average number of ethoxylate (EO) units present, said number being 8 or more, preferably 10 or more, and most preferably 15 to 30.

Examples of suitable nonionic surfactants include the ethoxylates of mixed natural or synthetic alcohols in the Acoco≅ or Atallow≅ chain length. Preferred materials are condensation products of coconut fatty alcohol with 15-20 moles of ethylene oxide and condensation products of tallow fatty alcohol with 10-20 moles of ethylene oxide.

The ethoxylates of secondary alcohols such as 3-hexadecanol, 2-octadecanol, 4-eicosanol, and 5-eicosanol may also be used. Exemplary ethoxylated secondary alcohols have formulae $C_{12}$-EO(20); $C_{14}$-EO(20); $C_{14}$-EO(25); and $C_{16}$-EO(30). Polyol-based nonionic surfactants may also be used, examples including sucrose esters (such as sucrose monooleate), alkyl polyglucosides (such as stearyl monoglucoside and stearyl triglucoside), and alkyl polyglycerols.

Suitable cationic surfactants include single long chain ($C_{8-40}$) cationic surfactants. The single long chain cationic surfactant is preferably a quaternary ammonium compound comprising a hydrocarbyl chain having 8 to 40 carbon atoms, more preferably 8 to 30, most preferably 12 to 25 carbon atoms (e.g. quaternary ammonium compounds comprising a $C_{10-14}$ hydrocarbyl chain are especially preferred).

Examples of commercially available single long hydrocarbyl chain cationic surfactants which may be used in the compositions of the invention include: ETHOQUAD® 0/12 (oleylbis(2-hydroxyethyl)methylammonium chloride); ETHOQUAD® C12 (cocobis(2-hydroxyethyl)methyl ammonium chloride) and /ETHOQUAD® C25 (polyoxyethylene(15)cocomethyl-ammonium chloride), all ex Akzo Nobel; SERVAMINE KAC®, (cocotrimethylammonium methosulphate), ex Condea; REWOQUAT® CPEM, (coconutalkylpentaethoxymethylammonium methosulphate), ex Witco; cetyltrimethylammonium chloride; RADIAQUAT® 6460, (coconut oil trimethylammonium chloride), ex Fina Chemicals; NORAMIUM® MC50, (oleyltrimethylammonium chloride), ex Elf Atochem.

Preferably, the composition comprises an emulsifier that has an HLB of from 7 to 20, more preferably from 10 to 20, and most preferably from 15 to 20.

A particular surfactant may be useful in the present compositions alone or in combination with other surfactants. The preferred amounts of emulsifier indicated below refer to the total amount of such materials that are present in the composition.

The total amount of emulsifier that is present is preferably from 0.05 to 10%, more preferably 0.1 to 5%, and most preferably 0.35 to 3.5%, based on the total weight of the composition. The weight ratio of the total amount of emulsifier to the amount of emulsified oil is preferably from 1:30 to 1:1, in particular from 1:25 to 1:5, and especially from 1:20 to 1:10.

The Aqueous Base

The aqueous base typically comprises 80% or greater by weight of water; sometimes this FIGURE may rise to 90% or greater, or 95% or greater. The water in the aqueous base typically comprises 40% or greater by weight of the total formulation; preferably this FIGURE is 60% or greater, more preferably it is 70% or greater.

The aqueous base may also comprise water-soluble species, such as mineral salts or short chain ($C_{1-4}$) alcohols. The mineral salts may aid the attainment of the desired phase volume for the composition, as may water soluble organic salts and cationic deflocculating polymers, as described in EP 41,698 A2 (Unilever). Such salts may be present at from 0.001 to 1% and preferably at from 0.005 to 0.1% by weight of the total composition. Examples of suitable mineral salts for this purpose include calcium chloride and magnesium chloride. Short chain alcohols that may be present include primary alcohols, such as ethanol, propanol, and butanol, secondary alcohols such as isopropanol, and polyhydric alcohols such as propylene glycol and glycerol. The short chain alcohol may be added with cationic softening agent during the preparation of the composition.

Thickener

A thickener is a preferred component of the compositions of the invention, serving to promote the desired thick and creamy appearance. Polymeric thickeners are particularly preferred.

The molecular weight of the thickener is preferably from 1,000 to 1,000,000, more preferably from 50,000 to 500,000 and most preferably from 100,000 to 400,000.

When present, the thickener is typically used at a level of at least 0.0005%, in particular at from 0.0005 to 2%, and especially at from 0.001 to 0.5% by weight of the total composition.

The thickener may be a continuous phase thickener, such as Softgel BDA; however, associative thickeners are preferred for optimal rheological profiles.

Suitable associative thickeners may be selected from hydrophobically modified cellulose ethers, as described in GB 2,043,646 (Hercules) and disclosed in fabric conditioning compositions in EP 331,237 B1 (Unilever). Such materials are typically nonionic polymers and have a sufficient degree of nonionic substitution selected from the class consisting of methyl, hydroxyethyl and hydroxypropyl to cause them to be water-soluble and which are further substituted with one or more hydrocarbon radicals having from 10 to 24 carbon atoms, in an amount from 0.2% by weight to an amount which renders the cellulose ether less than 1% by weight soluble in water. The nonionic cellulose ether that forms the >backbone= of the hydrophobically modified derivative may be any nonionic water soluble cellulose ether substrate, such as hydroxyethyl celluose (HEC), hydroxypropyl cellulose (HPC), methyl cellulose, hydroxypropyl methyl cellulose, ethyl hydroxyethyl celluose or methyl hydroxyethyl celluose. The preferred >backbone=is HEC.

Other suitable associative thickeners include the Collacral range (ethoxylate urethanes) from BASF, the PureThix range from Sud-Chemie, the Aquaflow range (HM end-capped PEGs) from Aqualon, and the Nexton range (HMHEC), also from Aqualon.

Especially preferred associative thickeners are hydrophobically modified cellulose ethers sold under the trade names Natrosol Plus 100, 250, 331, and 430, by Hercules.

Fatty Complexing Agent

A preferred additional component in the compositions of the present invention is a fatty completing agent. Such agents typically have a $C_8$ to $C_{22}$ hydrocarbyl chain present as part of their molecular structure. Suitable fatty complexing agents include $C_8$ to $C_{22}$ fatty alcohols and $C_8$ to $C_{22}$ fatty acids; of these, the $C_8$ to $C_{22}$ fatty alcohols are most preferred. A fatty complexing agent is particularly valuable in compositions comprising a QAC having a single $C_{12-28}$ group connected to the nitrogen head group, such as mono-ester associated with a TEA ester quat. or a softening agent of formula II, for reasons of product stability and effectiveness.

Preferred fatty acid complexing agents include hardened tallow fatty acid (available as Pristerene, ex Uniqema).

Preferred fatty alcohol complexing agents include hardened tallow alcohol (available as Stenol and Hydrenol, ex Cognis, and Laurex CS, ex Albright and Wilson) and behenyl alcohol, a $C_{22}$ fatty alcohol, available as Lanette 22, ex Henkel.

The fatty complexing agent may be used at from 0.1% to 10%, particularly at from 0.5% to 5%, and especially at from 0.75 to 2% by weight, based on the total weight of the composition.

Perfume

The compositions of the invention typically comprise one or more perfumes. The perfume is preferably present in an amount from 0.01 to 10% by weight, more preferably 0.05 to 5% by weight, most preferably 0.5 to 4.0% by weight, based on the total weight of the composition.

Co-Softener

Co-softeners may be used together with the cationic softening agent. When employed, they are typically present at from 0.1 to 20% and particularly at from 0.5 to 10%, based on the total weight of the composition. Preferred co-softeners include fatty esters, and fatty N-oxides.

Fatty esters that may be employed include fatty monoesters, such as glycerol monostearate, fatty sugar esters, such as those disclosed WO 01/46361 (Unilever).

Further Optional Ingredients

The compositions of the invention may contain one or more other ingredients. Such ingredients include preservatives (e.g. bactericides), pH buffering agents, perfume carriers, fluorescers, colourants, hydrotropes, antifoaming agents, anti-redeposition agents, soil-release agents, polyelectrolytes, enzymes, optical brightening agents, anti-shrinking agents, anti-wrinkle agents, anti-spotting agents, anti-oxidants, sunscreens, anti-corrosion agents, drape imparting agents, anti-static agents, ironing aids and dyes.

A particularly preferred optional ingredient is an opacifier or pearlescer. Such ingredients can serve to further augment the creamy appearance of the compositions of the invention. Suitable materials may be selected from the Aqusol 0P30X range (ex Rohm and Haas), the PuriColour White range (ex Ciba) and the LameSoft™ range (ex Cognis). Such materials are typically used at a level of from 0.01 to 1% by weight of the total composition.

Product Use

The compositions of the present invention are preferably rinse conditioner compositions and may be used in the rinse cycle of a domestic laundry process.

The composition is preferably used in the rinse cycle of a home textile laundering operation, where, it may be added directly in an undiluted state to a washing machine, e.g. through a dispenser drawer or, for a top-loading washing machine, directly into the drum. Alternatively, it can be diluted prior to use. The compositions may also be used in a domestic hand-washing laundry operation.

It is also possible, though less desirable, for the compositions of the present invention to be used in industrial laundry operations, e.g. as a finishing agent for softening new clothes prior to sale to consumers.

Manufacture

The compositions according to the invention may be prepared by any of the means known in the art. In a preferred method of manufacture, an emulsion of the oil is prepared independently of a dispersion of the cationic fabric softener and the two are then mixed to give a composition according to the invention, the oil emulsion typically being added to the dispersion of the cationic fabric softener. In an alternative method, the oil and cationic fabric softening agent may be melted together and the co-melt then dispersed into an aqueous base using methods known in the art.

It is preferred that the droplet size of the emulsified oil is reduced by use of high shear milling equipment. It is further preferred that this process is performed on the emulsified oil prior to its mixing with the cationic fabric softening agent—the droplet size of the oil may be reduced to its required D[4,3] during this procedure.

EXAMPLES

The invention is further illustrated by the particular (non-limiting) examples described below. All amounts indicated are weight percentages of the total composition, unless otherwise indicated.

Emulsions of oil (13%) in demineralised water were prepared in the following manner, using 0.87% Coco 20 EO (Genapol C200, ex Clariant) as the emulsifier. The oil and the emulsifier were melted together at about 45° C. Water, at about 60° C., was then added with vigorous stirring. The mixture produced was passed through a high pressure homogeniser, the operating pressure being adjusted to attain the D[4,3] droplet sizes indicated in Table 1.

Three different types of oil were emulsified and six different D[4,3] droplet sizes were attained, as indicated in Table 1.

TABLE 1

| Emulsions of Oil | | | |
|---|---|---|---|
| Oil | Type | Supplier | D[4,3] (micron) |
| Emanon SCR-PK (SPE) | Sucrose polyester | Kao | 0.4 |
| Sunflower | Triglyceride | Anglia | 1.07 |
| Sunflower | Triglyceride | Anglia | 1.11 |

TABLE 1-continued

| Emulsions of Oil | | | |
|---|---|---|---|
| Oil | Type | Supplier | D[4,3] (micron) |
| Priolube 2045 (SEO) | Synthetic ester oil | Uniqema | 1.61 |
| Priolube 2045 (SEO) | Synthetic ester oil | Uniqema | 3.75 |
| Emanon SCR-PK (SPE) | Sucrose polyester | Kao | 8.00 |

A dispersion of cationic fabric softener (13%) in demineralised water was prepared in the following manner.

A co-melt of TEA ester quat. (Tetranyl AHT-LV, ex Kao), tallow alcohol (Hydrenol D, ex Cognis), and Coco 20 EO (Genapol C200, ex Clariant), in a ratio of 13:0.6:0.45, was prepared by heating the components together at about 65° C. In a separate vessel, demineralised water containing small amounts of anti-foam (Rhodorsil, ex Rhone-Poulenc) and preservative (Proxel GXL, ex Zeneca) was heated to 60° C. The co-melt was added slowly to the aqueous phase with stirring and circulation of the mixture through a loop including high shear milling equipment. Following addition of the co-melt, the mixture was allowed to cool with continued passage of the mixture through the high shear milling equipment. The ratio of the co-melt to the aqueous phase was such as to produce a dispersion comprising 13% TEA ester quat., 0.6% tallow alcohol, 0.45% Coco 20 EO, 0.005% anti-foam, and 0.008% preservative. The dispersion also comprised small amounts of fatty acid and isopropanol, these materials having been associated with the Tetranyl AHT-LV raw material (at levels of up to 2% and 15% of the raw material, respectively).

Liquid fabric softening compositions according to the invention were prepared by post-dosing samples of each of the oil emulsions indicated in Table 1 into samples of the dispersion of cationic fabric softener described above. Compositions having three different ratios of oil to cationic fabric softener were prepared: 1:12, 3:10, and 1:1. Details of the amounts of the major components in these compositions are given in Table 2.

TABLE 2

| Test Compositions | | | |
|---|---|---|---|
| | Examples | | |
| Component | 1-6 | 7-12 | 13-18 |
| Oil | 1 | 3 | 6.5 |
| TEA ester quat. | 12 | 10 | 6.5 |
| Tallow alcohol | 0.55 | 0.46 | 0.30 |
| Coco 20 EO | 0.48 | 0.55 | 0.66 |
| Water | To 100 | To 100 | To 100 |

Tables 3, 4, and 5 indicate the results obtained with each of the 18 Examples prepared. Reflectance values were measured using a Datacolor Spectraflash 600 Plus; dispenser residues are expressed as a weight percentage of the amount dosed; and the viscosity measurements were made on a Haake rotoviscometer, at ambient temperature, at 2/s.

TABLE 3

1% Oil; 12% Cationic Compositions

| Example | Oil Used | D[4, 3] of oil | Reflectance | Residue % w/w | Viscosity mPa · s |
|---|---|---|---|---|---|
| 1 | SPE | 0.4 | 27.1 | 4.9 | 334 |
| 2 | Sunflower | 1.07 | 37.4 | 5.3 | 295 |
| 3 | Sunflower | 1.11 | 41.7 | 5.5 | 270 |
| 4 | SEO | 1.61 | 34.2 | 5.3 | 297 |
| 5 | SEO | 3.75 | 26.1 | 5.4 | 283 |
| 6 | SPE | 8.00 | 21.7 | 8.1 | 392 |

TABLE 4

3% Oil; 10% Cationic Compositions.

| Example | Oil Used | D[4, 3] of oil | Reflectance | Residue % w/w | Viscosity mPa · s |
|---|---|---|---|---|---|
| 7 | SPE | 0.4 | 39.2 | 1.1 | 173 |
| 8 | Sunflower | 1.07 | 55.9 | 0 | 179 |
| 9 | Sunflower | 1.11 | 60.2 | 0.6 | 185 |
| 10 | SEO | 1.61 | 51.9 | 1.0 | 205 |
| 11 | SEO | 3.75 | 38.6 | 1.2 | 192 |
| 12 | SPE | 8.00 | 31.7 | 3.6 | 315 |

TABLE 5

6.5% Oil; 6.5% Cationic Compositions

| Example | Oil Used | D[4, 3] of oil | Reflectance | Residue % w/w | Viscosity mPa · s |
|---|---|---|---|---|---|
| 13 | SPE | 0.4 | 57.8 | 0.8 | 94 |
| 14 | Sunflower | 1.07 | 68.5 | 0 | 77 |
| 15 | Sunflower | 1.11 | 66.4 | 0 | 92 |
| 16 | SEO | 1.61 | 63.6 | 0.4 | 75 |
| 17 | SEO | 3.75 | 52.2 | 0.3 | 68 |
| 18 | SPE | 8.00 | 41.9 | 12.2 | 433 |

From the above results, it can be seen that high reflectance values are obtained across the range of oil droplet sizes investigated, in particular across the range from 0.4 to 3.75 microns (these samples also giving the lowest dispenser residues), and especially across the range from 1.07 to 1.61 microns.

The invention claimed is:

1. A method of manufacturing a liquid fabric softening composition comprising an aqueous base, a cationic fabric softening agent, an emulsified oil which has a refractive index at 25° C. of 1.45 or greater in an amount such that the weight ratio of oil to cationic fabric softening agent is from 1:12 to 1:1, wherein the D[4,3] droplet size of the emulsified oil is from 0.4 to 8 microns, and a fatty complexing agent which is a $C_8$ to $C_{22}$ fatty alcohol, characterized in that an emulsion of the oil is prepared independently of a dispersion of the cationic fabric softener and the two are then mixed.

2. A method according to claim 1, wherein the D[4,3] droplet size of the emulsified oil is from 0.4 to 4 microns.

3. A method according to claim 1, in which the composition additionally comprises an emulsifier.

4. A method according to claim 3, in which the composition comprises a nonionic surfactant.

5. A method according to claim 1, wherein the cationic fabric softening agent comprises a di-ester of triethanolammonium methylsulphate.

6. A method according to claim 1, in which the composition comprises an emulsified non-silicone oil.

7. A method according to claim 6, in which the composition comprises an ester oil.

8. A method according to claim 7, in which the composition comprises a sugar polyester oil.

9. A method according to claim 1, in which the composition comprises a thickener.

10. A method according to claim 9, in which the composition comprises an associative thickener.

11. A method according to claim 1, in which the composition comprises an opacifier or pearlescer.

12. A method according to claim 1, in which the composition has a viscosity of from 100 to 1000 mPas.

13. A method as claimed in claim 1, in which the emulsified oil is subject to high shear milling to obtain the required D[4,3] droplet size prior to mixing with the dispersion of the cationic fabric softener.

* * * * *